US006626975B1

(12) United States Patent
Gries et al.

(10) Patent No.: US 6,626,975 B1
(45) Date of Patent: Sep. 30, 2003

(54) METHOD FOR PRODUCING HARD METAL MIXTURES

(75) Inventors: Benno Gries, Wolfenbüttel (DE); Jörg Bredthauer, Bonn (DE)

(73) Assignee: H. C. Starck GmbH & Co. KG, Goslar (DE)

( * ) Notice: Subject to any disclaimer, the term of this patent is extended or adjusted under 35 U.S.C. 154(b) by 0 days.

(21) Appl. No.: 09/889,299

(22) PCT Filed: Jan. 5, 2000

(86) PCT No.: PCT/EP00/00043

§ 371 (c)(1),
(2), (4) Date: Jul. 13, 2001

(87) PCT Pub. No.: WO00/42230

PCT Pub. Date: Jul. 20, 2000

(30) Foreign Application Priority Data

Jan. 15, 1999 (DE) ..... 199 01 305

(51) Int. Cl.[7] ..... B22F 1/00; B22F 3/00
(52) U.S. Cl. ..... 75/228; 419/32; 428/404
(58) Field of Search ..... 419/32, 33; 75/228; 428/404

(56) References Cited

U.S. PATENT DOCUMENTS

| | | | | |
|---|---|---|---|---|
| 3,348,779 A | | 10/1967 | Andrews | 241/39 |
| 4,320,156 A | | 3/1982 | Oakes et al. | 427/213 |
| 4,747,550 A | | 5/1988 | Jäckering | 241/55 |
| 4,848,919 A | | 7/1989 | Lipp et al. | 366/295 |
| 4,886,638 A | | 12/1989 | Penkunas et al. | 419/15 |
| 4,902,471 A | | 2/1990 | Penkunas et al. | 419/33 |
| 5,007,957 A | | 4/1991 | Penkunas | 75/252 |
| 5,045,277 A | | 9/1991 | Penkunas et al. | 419/15 |
| 5,403,541 A | * | 4/1995 | Oskarsson et al. | 419/13 |
| 5,505,902 A | | 4/1996 | Fischer et al. | 419/10 |
| 5,529,804 A | | 6/1996 | Bonneau et al. | 427/217 |
| 5,922,978 A | | 7/1999 | Carroll | 75/240 |
| 6,245,288 B1 | | 6/2001 | Carroll | 419/34 |
| 6,352,571 B1 | | 3/2002 | Waldenström et al. | 75/351 |

FOREIGN PATENT DOCUMENTS

| | | |
|---|---|---|
| DE | 29 515 434 | 11/1995 |
| DE | 295 15 434 | 1/1996 |
| EP | 0 474 102 | 11/1995 |
| EP | 0 645 179 | 6/1997 |
| EP | 0 819 777 | 10/2001 |
| GB | 346473 | 4/1931 |
| WO | 95/26843 | 10/1995 |
| WO | 98/03690 | 1/1998 |
| WO | 98/03691 | 1/1998 |
| WO | 98/18973 | 5/1998 |
| WO | 00/03049 | 1/2000 |

* cited by examiner

*Primary Examiner*—Ngoclan Mai
(74) *Attorney, Agent, or Firm*—Godfried R. Akorli; Diderico van Eyl

(57) ABSTRACT

The invention relates to a method for producing a homogeneous mixture of hard material powders and binder metal powders without using grinding bodies, liquid grinding auxiliary agents and suspending media. According to the invention, the mixture components are mixed at close range while generating a high shearing collision velocity of the powder particles and are remotely mixed by rotating the mixing bed without resulting in a particle size reduction of the hard material powders.

39 Claims, 8 Drawing Sheets

METHOD FOR PRODUCING HARD METAL MIXTURES

Hard metals are materials comprising hard materials and binder metals. They are important as wear-resistant materials and are used in shaping operations with and without metal cutting.

Hard materials are carbides, nitrides or carbonitrides of refractory metals of Subgroups IV, V and VI of the periodic table of the elements, the most important of which being titanium carbide (TiC), titanium carbonitride (Ti(C,N)) and particularly tungsten carbide (WC).

Cobalt is used in particular as a binder metal. However, mixed metal powders or alloy powders comprising cobalt, nickel and iron and optionally other constituents are used in minor amounts.

In order to produce hard metals, hard materials and binder metal, each in powder form, are intimately mixed, pressed and subsequently sintered, whereupon the binder metal results in the formation of a melt during sintering and thus facilitates very extensive densification and the formation of a multi-phase microstructure which exhibits an advantageous bending strength and fracture toughness. The optimum effect of the binder metal is achieved if complete wetting of the hard material phase is effected. The solubility of the hard material in the binder, which depends on the sintering temperature, results in partial redissolution and rearrangement of the hard material, so that a microstructure is obtained which is very resistant to crack propagation. The result of sintering can be represented in the form of the residual porosity. A necessary prerequisite for the achievement of a satisfactory fracture toughness is that the residual porosity must not be less than a defined value.

Hard materials with average particle sizes according to ASTM B 330 of 3 to 20$\mu$, preferably 3 to 10$\mu$, are normally used. Very finely divided contents of hard materials should be avoided, since they tend to recrystallise during liquid phase sintering (Ostwald ripening). Crystallites which have grown in this manner contain multi-dimensional point defects, which are disadvantageous with regard to certain service properties of hard metals, particularly when they are used for the machining of steel, in mining and for impact tools. For example, tungsten carbide can be plastically deformed to a certain degree if multi-dimensional point defects are removed at high temperatures above 1900° C. The carburisation temperature at which the tungsten carbide was produced therefore has a significant effect on the service properties of hard metals. The fraction of the tungsten carbide phase which remains undissolved in the hard metal at the sintering temperature, which is typically between 1360 and 1450° C., is qualitatively inferior to the non-redissolved fraction as regards these service properties. Further embrittlement can occur due to the incorporation of binder metals in the lattice by WC fractions which have grown by redissolution.

The binder metal which is used is generally of smaller particle size, and is typically about 1 to 2$\mu$ according to ASTM B 330.

The binder metal is used in an amount such that that it corresponds to about 3 to 25% by weight of the hard metal.

Up to 50% of ground, recycled sinterable hard metal powders can advantageously be used in conjunction.

Apart from the choice of hard material which is suitable in each case (particle size, particle size distribution, crystal structure) and of a suitable binder metal (composition, amount, fraction of hard metal), and of the sintering conditions, the production of suitable hard metal mixtures, i.e. the mixing of hard material and binder before sintering, plays a decisive part with respect to the subsequent properties of the hard metal.

On account of the electrostatic forces of repulsion between fine particles of powder (which always result in finer powders having lower bulk densities), different particle sizes and densities, and the unfavourable quantitative relationship between the two components, dry mixing has not been successful according to the prior art. The electrostatic forces of repulsion between the particles can in fact be overcome by employing dry grinding, but this would result in comminution of the particles, particularly those of the hard metal, since very many fine fractions would be produced. Moreover, unavoidable wear on the grinding tools is a problem which has not been solved hitherto.

Accordingly, wet grinding in an attrition mill or in a ball mill using an organic grinding liquid and grinding balls has been widely used as the method which is employed industrially for the production of hard metal mixtures. Moreover, by using a grinding liquid, the electrostatic forces of repulsion are effectively suppressed. In fact, by employing wet mixing in an attrition mill it is possible to keep the comminution of the grains of the hard material within acceptable limits, but mixed grinding is a very costly procedure, firstly due to its high space requirement on account of the requisite ratio by volume of grinding agents to the material being ground of about 6:1, and secondly due to the grinding times of 4 to 48 hours which are required. Added to this, there is the requirement of separating the grinding balls from the hard metal mixture by sieving after mixed grinding, and of separating the organic grinding liquid by evaporation. A certain degree of wear on the mill and a certain degree of comminution of the grains also have to be accepted when wet mixed grinding is employed. Those WC powders which are carburised at at least 1900° C., which have a narrow particle size distribution without a proportion of fines, and which therefore have to be converted into very high grade hard metals without redissolution processes, are particularly affected by the above disadvantages.

According to one very old proposal (GB Patent 346 473), the problems of mixing hard materials and binder metal are claimed to be solved by electrolytically coating the hard material with the binder metal. However, this method has not achieved widespread use. According to more recent proposals (U.S. Pat. Nos. 5,505,902 and 5,529,804), the binder metal, particularly cobalt, is chemically deposited on the particles of hard material. However, this necessitates the use of organic liquid phases which are not without effect on the carbon content of the hard metal. The object of the present invention is to provide a method of producing a hard metal mixture which avoids the disadvantages of the prior art, which in particular is less costly on an industrial scale, and which furthermore, due to the homogeneity of the mixture and due to the avoidance of comminution of the particles of the hard material after sintering, results in hard metals which have outstanding service properties due to the minimization of the redissolved fraction of the WC phase.

It has been found that this object can be achieved by effecting short-range mixing of the mix material with the generation of a high shearing impact velocity of the powder particles, and by effecting long-range mixing by recirculation of the mix material.

In this manner, dry mixing of the hard material and binder metal powders can be achieved substantially without particle comminution, without the use of grinding agents, grinding aids or liquid suspending agents.

The expression "short-range mixing" is to be understood according to the invention as the mixing of a partial amount of the mix material, whereas long-range mixing denotes the mixing of the bulk of the mixture batch, i.e. of the partial amounts thereof with each other.

The method according to the invention therefore firstly consists of mixing the powder particles with each other using short-range mixing with a high input of mixing energy (with respect to the amount of powder acted upon by the mixing element) in order to overcome the electrostatic forces of repulsion between the powder particles, and secondly consists of effecting long-range mixing with a reduced energy input in order to homogenise the powder mixture.

According to the invention, different mixing units are preferred for short-range and for long-range mixing.

The bulk of the mix material is situated in the region of long-range mixing due to the recirculation of the mixture bed. Examples of suitable devices for this purpose include rotary drums, plough blade mixers, paddle mixers and tapered worm mixers.

A partial amount of the mixture is situated in the region of short-range mixing, comprising a mixing unit which generates high relative impact velocities. Units which are particularly suitable for short-range mixing are rapidly rotating mixing elements. The mixing units which are preferred according to the invention are those with peripheral velocities of 8 to 25 m/sec, and those with peripheral velocities of 12 to 18 m/sec are particularly preferred. The mix material is preferably fluidised, at least in the region of short-range mixing, in the gas atmosphere of the mixing vessel, wherein the gas is intensively swirled by the mixing element and the powder particles impinge on each other due to the prevailing shear velocities in the resulting turbulence. One example of a suitable mixing element is a high speed stirring element which is provided with stirring blades which run at its walls, wherein a gap remains between the vessel wall and the stirring blade, the width of which gap is at least 50 times the particle diameter. The gap width preferably amounts to 100 to 500 times the particle size.

Examples of other units which are suitable for short-range mixing include those which are known from U.S. Pat. Nos. 3,348,779, 4,747,55, EP-A 200 003, EP-A 474 102, EP-A 645 179 and from DE-U 29 515 434, and which have been termed microfluidiser mills. Mills of this type consist of a stator in the form of a cylindrical housing in which a rotor is axially disposed which comprises one or more circular discs disposed one above another on a common shaft which can be driven, wherein the circular discs have a plurality of substantially radial grinding plates, which are parallel to the rotor axis, on their peripheries. The grinding plates protrude beyond the circular discs leaving a gap between the stator and grinding plates which is termed the "shearing gap". When the rotor is driven at high speeds of rotation, typically at 1000 to 5000 rpm, the particles which are situated in the microfluidiser mill and which are dispersed in the gas are subjected to high forces of acceleration due to the shear velocity of the gas between the rotor and the stator, so that the particles impinge on each other, thereby overcoming the electrostatic forces of repulsion between them. On the impact of the particles, an exchange of charges or a dielectric charge reversal takes place, so that the forces of repulsion between the particles are eliminated after impact.

According to the invention, the shearing gap between the rotor and the stator should preferably have a clear width which is at least the 50 times the average diameter of the size of particles with the larger average diameter, i.e. the hard material particles. The preferred shearing gap has a clear width which corresponds to 100 to 500 times the average diameter of the hard material particles. Accordingly, the shearing gap typically has a clear width from 0.5 to 5 mm, preferably from 1 to 3 mm.

The shear velocity in the shearing gap, expressed as the ratio of the peripheral velocity of the rotor to the gap width, is preferably at least 800/sec, most preferably 1000 to 20,000/sec.

The dwell time for short-range mixing is selected so that the temperature of the powder mixture when subjected to short-range mixing does not exceed 300° C. If mixing is effected in an atmosphere which contains oxygen, particularly air, lower temperatures are preferred in order reliably to prevent the oxidation of the powder particles. If mixing is effected in a protective gas atmosphere, for example in argon, temperatures up to 500° C. are permissible if necessary. The dwell time for short-range mixing typically falls within the range of seconds.

The total mixing time is preferably 30 to 90 minutes, most preferably more than 40 minutes, and is most particularly less than one hour.

According to one preferred embodiment of the invention, the powder mixture is recirculated between the short-range and long-range mixing operations, i.e. partial amounts of the powder mixture are taken off from the long-range mixing operation as a continuous partial stream, are fed to the short-range mixing operation and are introduced again into the long-range mixing operation.

The speed of rotation of the powder mixture during short-range mixing is preferably selected so that of at least 5 passes on average, most preferably at least 10 passes, are ensured over the total mixing time.

When the method is carried out continuously, the two powder components or a crude mixture of the powder components can continuously be fed to one end of the recirculating mixing unit, and homogeneously mixed powder can continuously be withdrawn via a lock at the other end.

An alternative procedure for carrying out the method continuously consists of producing a crude mixture of the powder components in a first recirculating mixing unit, continuously removing the crude mixture from the first recirculating mixing unit, introducing said mixture via a lock into the microfluidiser mill and subsequently feeding it to a second recirculating mixing unit, wherein it may be advantageous, downstream of said second recirculating mixing unit, to carry out additional short-range mixing in a microfluidiser mill and subsequently to carry out additional long-range mixing in a recirculating mixing unit.

According to another preferred embodiment of the invention, the mix material is fluidised both during short-range mixing and during long-range mixing. One suitable procedure for this purpose, for example, comprises a rotor which moves at the base and at the wall with a shearing gap towards the vessel wall, wherein the radial rotor blades are set in relation to the vertical so that the fluidised mixing material is conveyed upwards at the periphery and downwards at the centre of the vessel. The setting angle is preferably less than 25°, most preferably 10 to 200. This circulation of the mix material to the long-range mixing zone can be intensified by a coaxial rotor which is set in an opposite direction and which has a diameter which is limited to only half the vessel cross-section. It has been found that, in a unit of this type, excellent hard metal mixtures are still produced when up to 7% by volume of the vessel (weight of the mix material divided by the density of the powder material) is filled.

The additives which are used in the hard metal industry for the further processing of powder mixtures, such as organic bonding agents, antioxidants, granule stabilisers and/or pressing aids, e.g. those based on paraffin or polyethylene glycol, can advantageously be mixed with the hard material and binder powders and homogeneously distributed therewith. Due to the heat evolved during the mixing operation, the pressing aids melt, so that a uniform coverage of the surface is obtained. If the mixtures which are produced in this manner are still not sufficiently flowable or pressable, a granulation step can be added downstream.

The hard metal mixtures according to the invention and granules thereof are suitable for the production of hard metal mouldings by axial pressing or isostatic pressing, or by extrusion or injection moulding and sintering.

The invention is explained in more detail with reference to the accompanying Figures.

Figure 1:
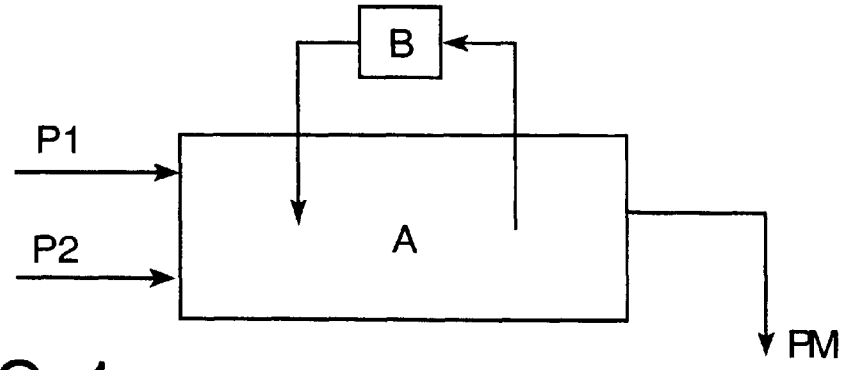
FIG. 1 is a schematic illustration of a first embodiment of the invention.

FIG. 1 is a schematic illustration of a long-range mixing device A into which the two powders P1 and P2 are introduced continuously or batch-wise. A partial stream of the powder mixture is continuously fed from the long-range mixing unit A into the short-range mixing unit B and is recycled to the long-range mixing unit A. Finally, the finished powder mixture is withdrawn, continuously or batch-wise, from the long-range mixing unit A.

Figure 2:
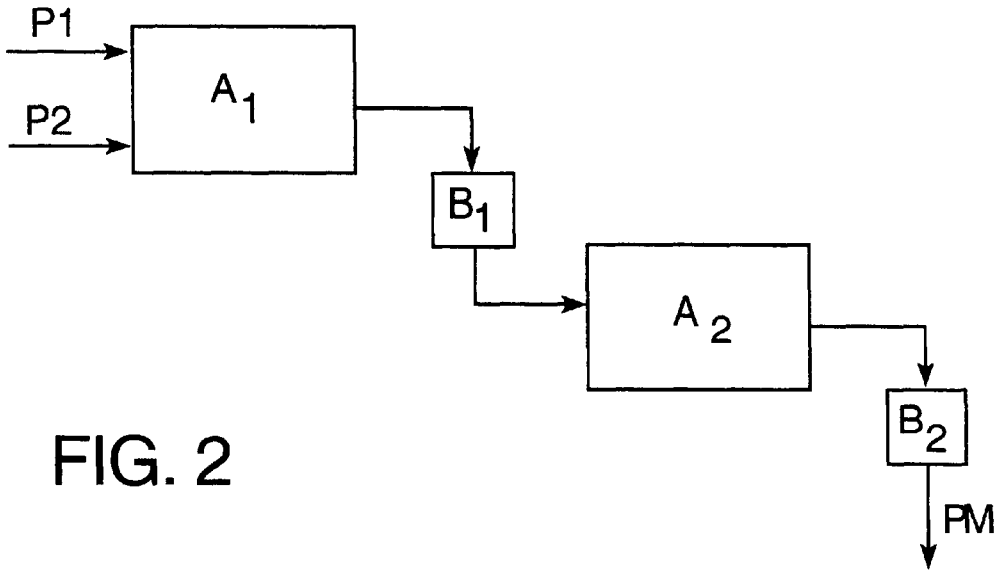
FIG. 2 is a schematic illustration of a second embodiment of the invention.

FIG. 2 shows a schematic arrangement which is suitable for continuously carrying out the method according to the invention. The powders P1 and P2 are introduced into a first long-range mixing unit, and are introduced in particular into a rotary drum for example. From the rotary drum, they enter a first microfluidiser mill B1 and are subsequently transferred to a second long-range mixing unit A2. Further short-range mixing B2 and long-range mixing A3, which is not illustrated, can optionally be added.

Figure 3:
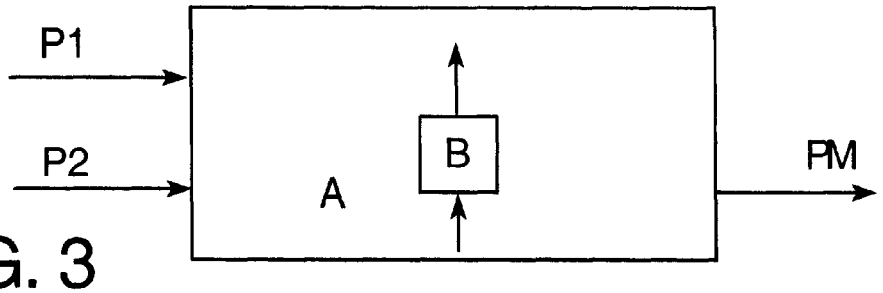
FIG. 3 is a schematic illustration of a third embodiment of the invention.

FIG. 3 shows an arrangement which is particularly suitable for batch mixing. The microfluidiser mill B is disposed as a short-range mixing element inside the long-range mixing element A.

Figure 4:
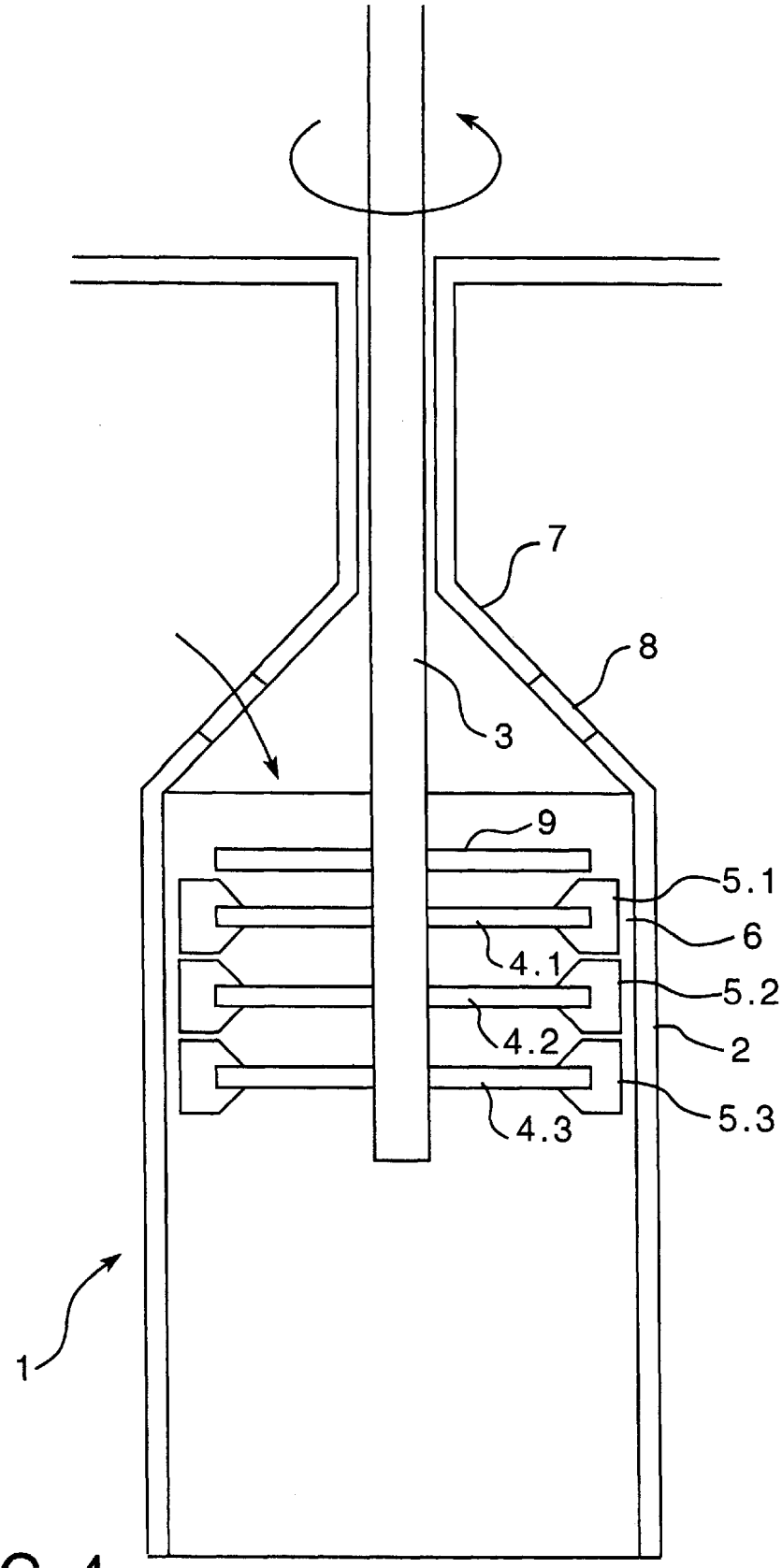
FIG. 4 is a sectional drawing showing the basic construction of a microfluidiser.

FIG. 4 shows the construction of a microfluidiser mill 1. This consists of a cylindrical housing 2, the inner wall of which forms the stator. The inner wall of the cylindrical housing 2 can be clad with an abrasion-resistant material. A shaft 3 which can be driven in rotation is provided inside the cylindrical housing 2. One or more, particularly 2 to 5, circular discs 4.1, 4.2 and 4.3 which can be driven with the shaft are provided on the shaft 3. On their peripheries, the shafts each have a plurality of radial grinding plates 5.1, 5.2 and 5.3 which are parallel to the shaft 3. Together with the inner wall of the cylindrical housing 2, the outer edges of the grinding plates 5.1, 5.2 and 5.3 form the shearing gap 6. If the microfluidiser mill is disposed inside a long-range mixing element below the filling level thereof, the microfluidiser mill also has what is preferably a conical cover 7 which is provided with openings through which the flowable powder can readily trickle into the cylindrical housing 2. An additional circular disc 9 which is provided on the shaft 3 can act as a distributor plate.

Figure 5:
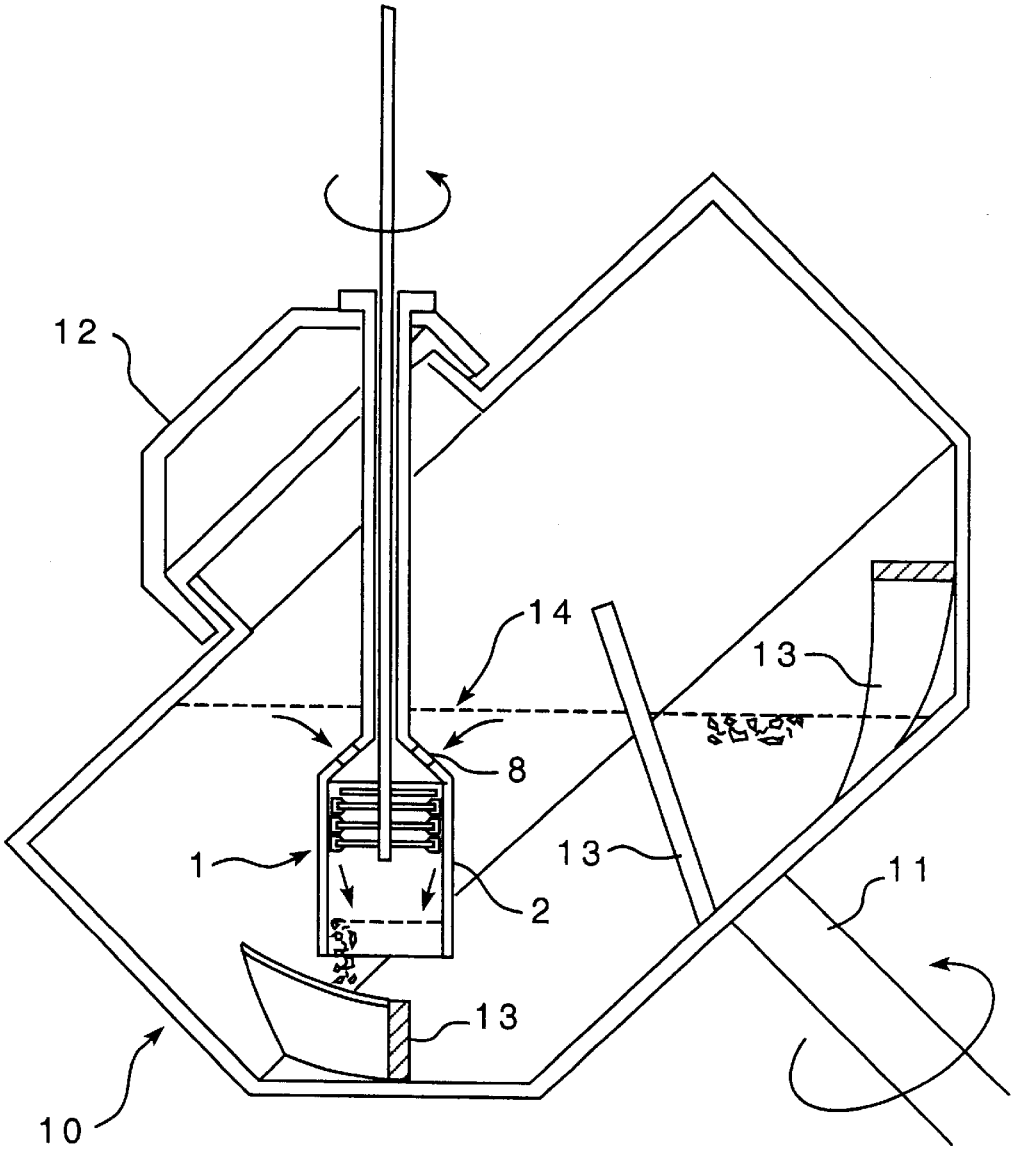
FIG. 5 is a sectional drawing of a mixing apparatus which is suitable according to the invention.

FIG. 5 shows an apparatus which can be used according to the invention, such as that which is schematically illustrated in FIG. 3. It consists of a mixing drum 10, which can be driven in rotation at a slow speed of rotation, for example at 1 to 2 revolutions per minute, via the shaft 11. The drum is closed by the cover cap 12, which does not rotate with it. The microfluidiser mill 1 is situated inside the drum 10, as illustrated in FIG. 4. Baffles 13 can also be disposed inside the drum 10. The filling level of the drum 10 is indicated by the dashed line 14. In the method according to the invention, the powder mixture then continuously enters the microfluidiser mill 1, where short-range mixing occurs, through the openings 8, and is recycled to the long-range mixing operation through the cylinder which is open at the bottom.

Figure 6A:
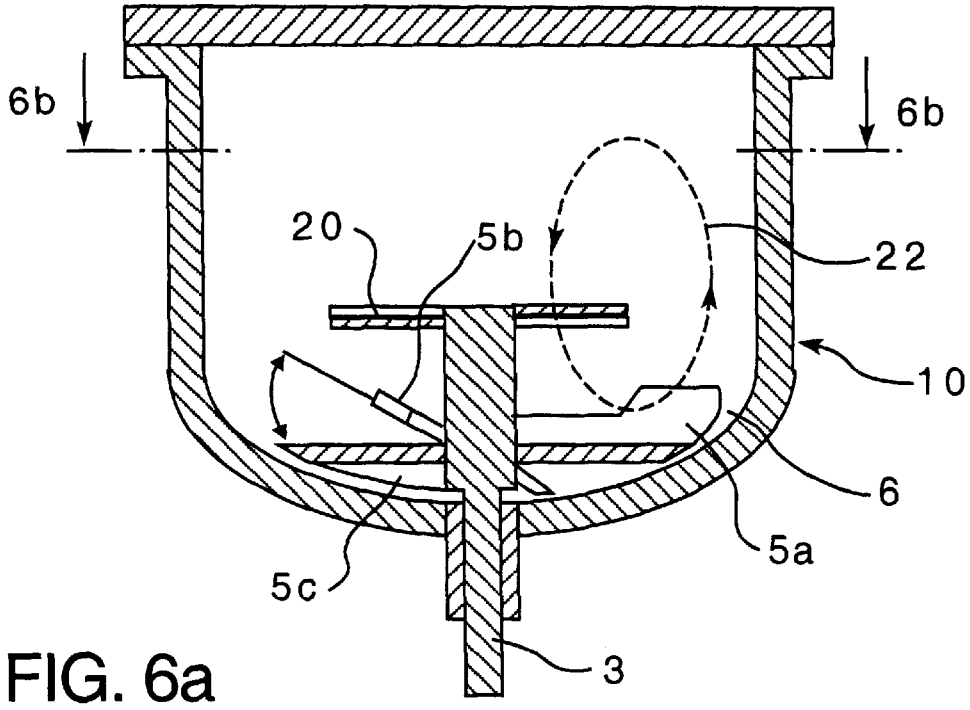
FIG. 6 shows another mixing apparatus which is suitable according to the invention.
Figure 6B:
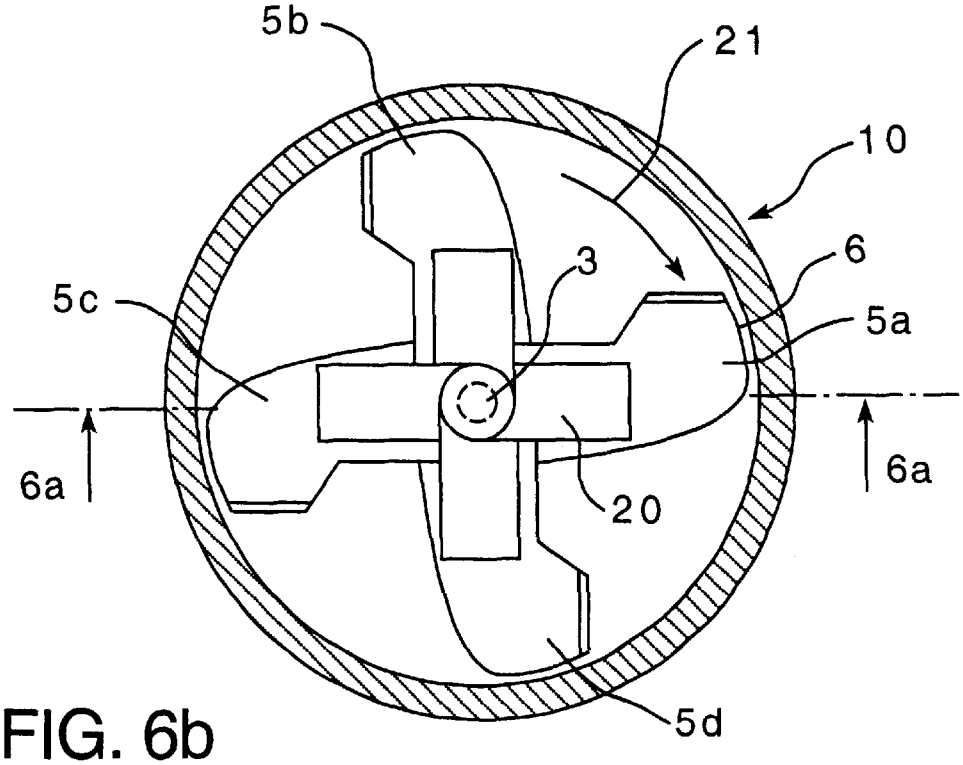

FIG. 6 shows an apparatus which can be used according to the invention and in which the mix material is fluidised, both during short-range mixing and during long-range mixing. The vessel 10 contains, on a driven shaft 3, a rotor which moves along the base and the walls and which comprises 4 rotor blades 5*a*, 5*b*, 5*c* and 5*d*, which form the shearing gap 6 towards the vessel wall. The rotor blades are set at an angle a $\alpha=23°$ in relation to the plane which is perpendicular to the rotor shaft. A rotor 20 which is set in an opposite direction, and the diameter of which is approximately half the vessel diameter, is provided on the shaft 3 above the rotor 5.

On the rotation of the shaft 3 in the direction of the arrows 21, the mix material is fluidised and is additionally circulated in rotation about the shaft 3 as indicated by the arrow 22. A partial amount of the fluidised mix material enters the shearing gap 6, here the high shearing velocity of the fluid results in considerable acceleration of the particles.

The invention is explained in more detail with reference to the following Examples:

EXAMPLE 1

Figure 7:
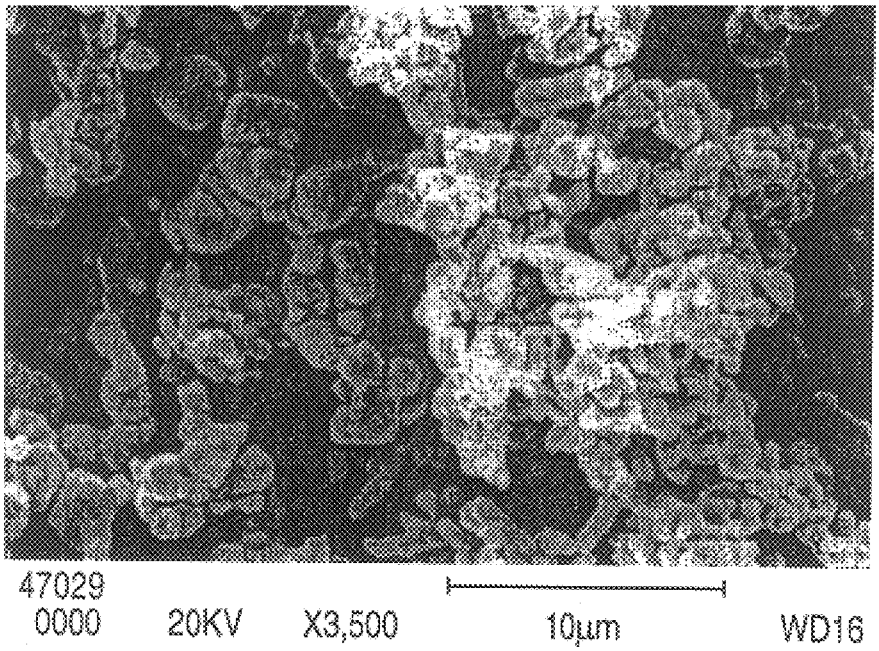
FIG. 7 is an SEM photograph of the tungsten carbide powder used in Example 1.

13.6 kg of a cobalt powder with an average particle size of 1.55 $\mu$m (FSSS, ASTM B 330) and 122.4 kg of a slightly agglomerated tungsten carbide powder with an average particle size of 3 $\mu$m (FSSS, ASTM B 330) were introduced into a mixing unit which is illustrated schematically in FIG. 5. FIG. 7 is an SEM photograph of the tungsten carbide powder before mixing.

Figure 8:
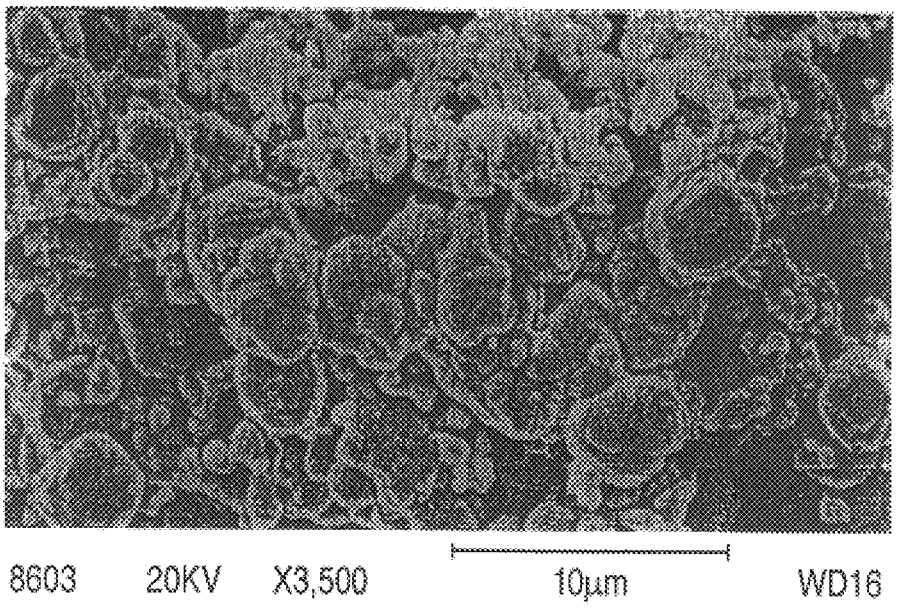
FIG. 8 is an SEM photograph of a tungsten carbide-cobalt powder mixture

Samples of the powder mixture were taken after mixing times of 20, 30 and 40 minutes. FIG. 8 is an SEM photograph of the powder mixture which was obtained after a mixing time of 40 minutes. The oxygen content before mixing was 0.068% by weight, and after mixing was 0.172% by weight.

The samples were processed to form hard metal test specimens by pressing and subsequent sintering at 1380° C. for 45 minutes.

For comparison, a corresponding powder mixture was ground for 20 hours in a ball mill with hexane. A hard metal test specimen was produced in the same manner from the comparison powder mixture.

The following properties of the test specimens were measured: the density in g/cm$^3$, the magnetic coercivity Hc in kA/m, the magnetic saturation in $\mu$Tm$^3$/kg (using a Foerster Koerzinat 1.096 in each case), the Vickers hardness under a 30 kg load in kg/mm$^2$ and the A porosity according to ISO 4505. The results are presented in Table 1.

EXAMPLE 2

11.9 kg of a cobalt metal powder with an average particle size of 1.5 $\mu$m and 122.4 kg of a slightly agglomerated tungsten carbide powder with an average particle size of 6 pm (FSSS, ASTM B 330) were mixed as in Example 1. Fhe oxygen content before mixing was 0.058% by weight, and after a mixing time of 40 minutes was 0.109% by weight.

A comparison mixture (Example 2f) was also produced in a ball mill, as in Example 1.

Figure 9:
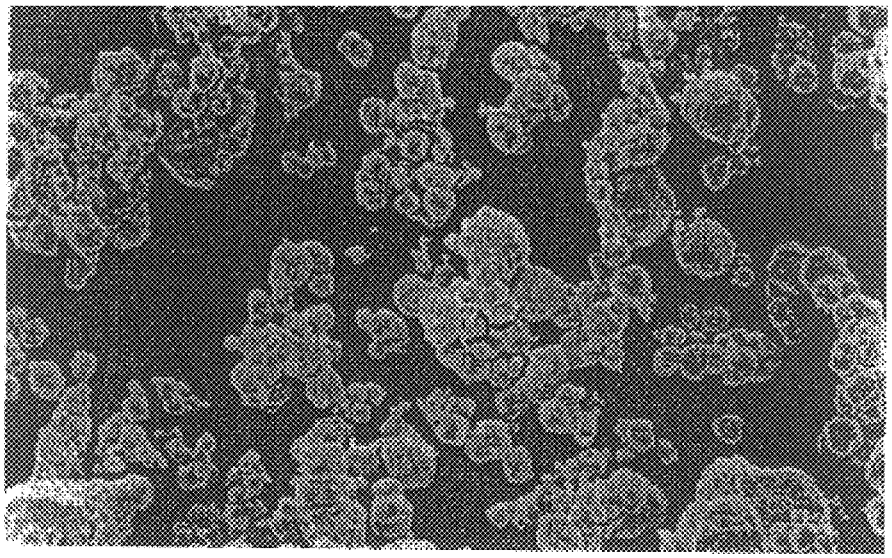
FIG. 9 is an SEM photograph of the tungsten carbide used in Example 2.
Figure 10:
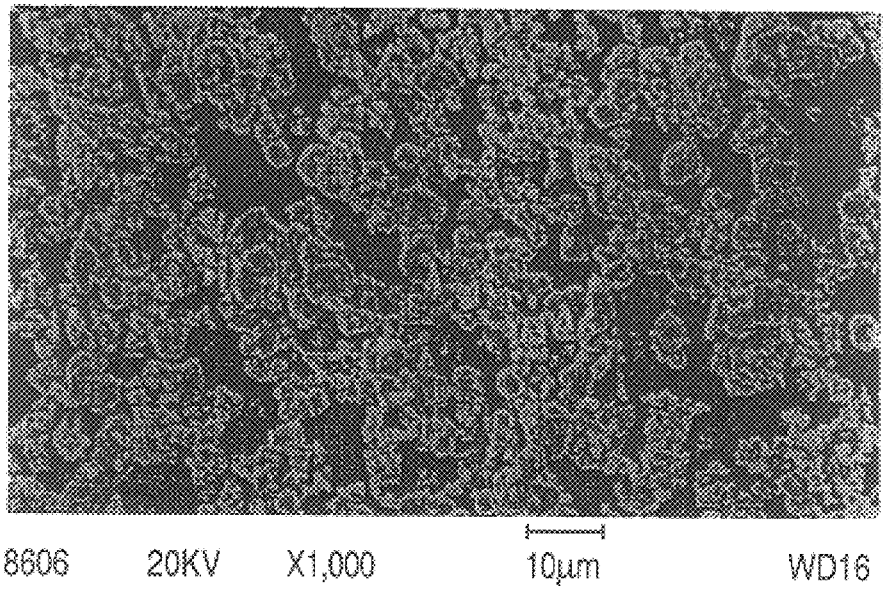
FIG. 10 is an SEM photograph of a tungsten carbide-cobalt powder mixture according to Example 2.

FIG. 9 is an SEM photograph of the initial tungsten carbide powder. FIG. 10 shows the powder mixture after a mixing time of 30 minutes.

Hard metal specimens were produced as in Example 1. The test results obtained are presented in Table 1.

Figure 11:
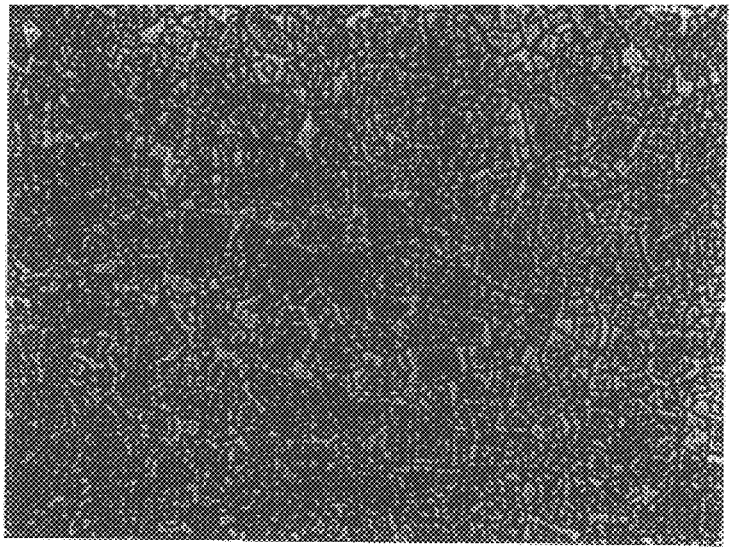
FIG. 11 is a polished section of a hard metal produced according to Example 2.

FIG. 11 is a polished section of a hard metal according to Example 2d).

EXAMPLE 3

Figure 12:
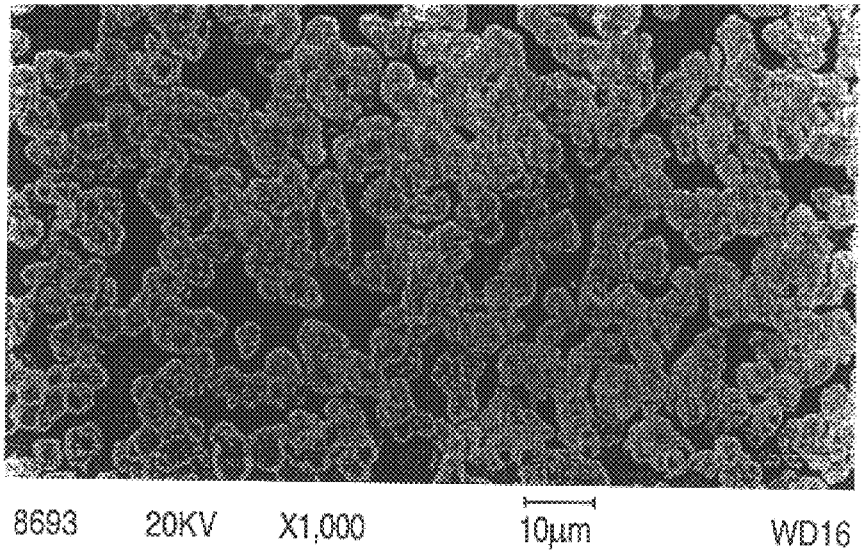
Figure 13:
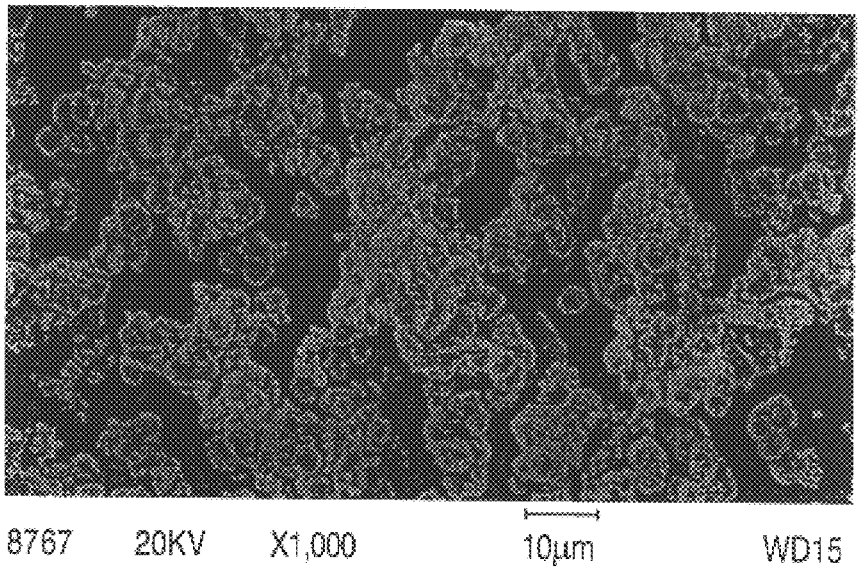

13 kg of a cobalt metal powder with an average particle size of 1.55 $\mu$m and 117 kg of a less agglomerated tungsten carbide powder (FIG. 12) were mixed as in Example 1. FIG. 13 is an SEM photograph of the powder mixture obtained. The oxygen content before mixing was 0.065% by weight, and after mixing was 0.088% by weight.

Figure 14:
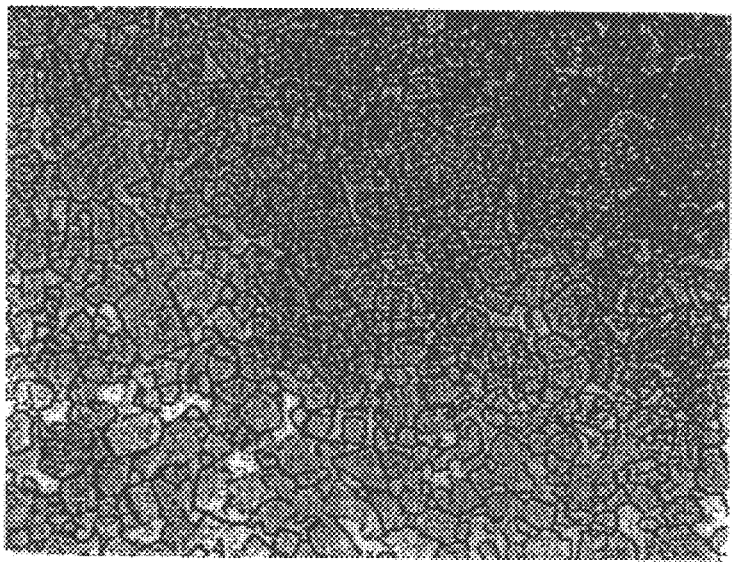
FIGS. 12, 13 and 14 are corresponding photographs relating to Example 3.

FIG. 14 is a polished section of the hard metal produced as in Example 1. The hard metal test results are presented in Table 1.

TABLE 1

| Ex. | Mixing time (min) | density (g/cm$^3$) | $H_c$ (kA/m) | $4\pi\sigma$ ($\mu$Tm$^3$/kg) | $HV_{30}$ (kg/mm$^2$) | A porosity ISO 4505 |
|---|---|---|---|---|---|---|
| 1a | 20 | 14.47 | 9.4 | 18.8 | 1226 | better than A02 |
| 1b | 30 | 14.52 | 9.2 | 18.1 | 1274 | better than A02 |
| 1c | 40 | 14.58 | 9.4 | 18.7 | 1311 | better than A02 |
| 1d | 1200 (comp.) | 14.52 | 10.4 | 18.4 | 1345 | better than A02 |
| 2a | 10 | 14.56 | 6.7 | 18.8 | 1198 | better than A02 |
| 2b | 15 | 14.56 | 6.7 | 18.7 | 1203 | better than A02 |
| 2c | 20 | 14.51 | 6.4 | 17.8 | 1190 | better than A02 |
| 2d | 30 | 14.55 | 6.5 | 18.1 | 1203 | better than A02 |
| 2e | 40 | 14.59 | 6.5 | 18.5 | 1203 | better than A02 |
| 2f | 1200 (Vgl.) | 14.55 | 7.3 | 18.0 | 1261 | better than A02 |
| 3 | 40 | 14.51 | 6.9 | 18.6 | 1203 | better than A02 |

EXAMPLE 4

2.6 kg cobalt metal powder, 1 $\mu$m FSSS according to ASTM B 330; 23.26 kg WC, 0.6 $\mu$m FSSS (according to ASTM B 330), and 0.143 kg $Cr_3C_2$, 1.6 $\mu$m according to ASTM B 330; as well as 375 g paraffin wax with a melting point of 54° C., were mixed in a mixer (as shown in FIG. 6) at 1000 rpm until a temperature of 80° C. was reached. The hard metal which was thus obtained was pressed at 1.5 t/cm$^2$ to form test specimens. These were first dewaxed in a sintering furnace and were then sintered at 1380° C. for 45 minutes under a pressure of 25 bar. The hard metal which was obtained had a density of 14.45 g/cm$^3$, a coercivity of 20.7 kA/m, a magnetic saturation of 15.14 $\mu$m$^3$/kg, a Vickers hardness HV=1603 kg/mm$^2$ and a residual porosity better than A02 B00 C00. The hard metal had a good microstructure and a good binder distribution.

EXAMPLE 5

2.57 kg cobalt metal powder; 1 $\mu$m FSSS according to ASTM B 330, and 26 kg WC, 6 $\mu$m FSSS according to ASTM B 330, were mixed as in Example 4 until a temperature of 80° C. was reached. The hard metal which was thus obtained was pressed at 1.5 t/cm$^2$ to form test specimens and was subsequently sintered at 1400° C. for 45 minutes under vacuum. The hard metal which was obtained had a density of 14.65 g/cm$^3$, a coercivity of 5.5 kA/m, a magnetic saturation of 17.11 $\mu$Tm$^3$/kg, a Vickers hardness $HV_{30}$=1181 kg/mm$^2$ and a residual porosity better than A02 B00 C00. The hard metal had a good microstructure and a good binder distribution.

What is claimed is:

1. A method for producing a homogeneous mixture of a mix material comprising powders of a hard material and of binder metal without the use of grinding agents, liquid grinding aids or suspending agents, comprising (a) subjecting a mix material to short-range mixing by generating a high shearing impact velocity of the powder particles, and (b) subjecting the mixing material to long-range mixing by recirculating the mix material, and thereby forming a homogeneous mixture of a mix material comprising powders of a hard material and a binder metal.

2. The method according to claim 1, wherein during short-term mixing, the mix material is fluidized and the high impact velocity is generated by the turbulence of the liquid.

3. The method according to claim 1, wherein that long-range mixing is effected in a stirred vessel with slowly rotating stirring elements.

4. The method according to claim 1, wherein the mix material is fluidized during both the short-range and long-range mixing.

5. The method according to claim 1, wherein the total mixing time is less than 1 hour.

6. The method according to claim 1, wherein the mix material additionally contains pressing aids.

7. The method according to claim 1, wherein the powder mixture is granulated.

8. The method according to claim 1, wherein the hard metal is selected from the group consisting of carbides, nitrides, carbonitrides of refractory metals of Subgroups IV, V, and VI of the periodic chart of elements, and combinations thereof.

9. The method according to claim 1, wherein the hard metal is selected from the group consisting of titanium carbide, titanium carbonitride, tungsten carbide, and combinations thereof.

10. A hard metal mixture produced according to claim 1.

11. A sintered hard metal molding produced from the hard metal mixture of claim 10.

12. A method for producing a homogeneous mixture of a mix material consisting of powders of a hard material and of binder metal without the use of grinding agents, liquid grinding aids or suspending agents, comprising:

(a) subjecting a mix material to short-range mixing by generating a high shearing impact velocity of the powder particles, and (b) subjecting the mixing material to long-range mixing by recirculating the mix material, and thereby forming a homogeneous mixture of a mix material consisting of powders of a hard material and of a binder metal, wherein the short-range mixing is carried out in a vessel fitted with rotor and stator elements with a shearing gap between the elements.

13. The method according to claim 12, wherein the shearing gap has a clear width which is at least 50 times average diameter of the type of particles with the larger average diameter.

14. The method according to claim 12, wherein during short-range mixing the mix material is fluidized and the high impact velocity is generated by the turbulence of the fluid.

15. The method according to claim 12, wherein the ratio of the relative velocity of the rotor and stator to the shearing gap width is at least 800/sec.

16. The method according to claim 12, wherein the rotor has a peripheral velocity ranging from 12 to 20 m/sec.

17. The method according to claim 12, wherein that long-range mixing is effected in a stirred vessel with slowly rotating stirring elements.

18. The method according to claim 12, wherein the mix material is fluidized during both the short-range and long-range mixing.

19. The method according to claim 12, wherein the total mixing time is less than 1 hour.

20. The method according to claim 12, wherein the mix material additionally contains pressing aids.

21. The method according to claim 12, wherein the powder mixture is granulated.

22. The method according to claim 12, wherein the hard metal is selected from the group consisting of carbides, nitrides, carbonitrides of refractory metals of Subgroups IV, V, and Vl of the periodic chart of elements, and combinations thereof.

23. The method according to claim 12, wherein the hard metal is selected from the group consisting of titanium carbide, titanium carbonitride, tungsten carbide, and combinations thereof.

24. A hard metal mixture produced according to claim 12.

25. A sintered hard metal molding produced from the hard metal mixture of claim 24.

26. A method for producing a homogeneous mixture of a mix material comprising of powders of a hard material and of binder metal without the use of grinding agents, liquid grinding aids or suspending agents, comprising:

(a) subjecting a mix material to short-range mixing by generating a high shearing impact velocity of the powder particles, and (b) subjecting the mixing material to long-range mixing by recirculating the mix material, and thereby forming a homogeneous mixture of a mix material comprising of powders of a hard material and of a binder metal, wherein the short-range mixing is carried out in a vessel fitted with rotor and stator elements with a shearing gap between the elements.

27. The method according to claim 26, wherein the shearing gap has a clear width which is at least 50 times average diameter of the type of particles with the larger average diameter.

28. The method according to claim 26, wherein during short-range mixing the mix material is fluidized and the high impact velocity is generated by the turbulence of the fluid.

29. The method according to claim 26, wherein the ratio of the relative velocity of the rotor and stator to the shearing gap width is at least 800/sec.

30. The method according to claim 26, wherein the rotor has a peripheral velocity ranging from 12 to 20 m/sec.

31. The method according to claim 26, wherein that long-range mixing is effected in a stirred vessel with slowly rotating stirring elements.

32. The method according to claim 26, wherein the mix material is fluidized during both the short-range and long-range mixing.

33. The method according to claim 26, wherein the total mixing time is less than 1 hour.

34. The method according to claim 26, wherein the mix material additionally contains pressing aids.

35. The method according to claim 26, wherein the powder mixture is granulated.

36. The method according to claim 26, wherein the hard metal is selected from the group consisting of carbides, nitrides, carbonitrides of refractory metals of Subgroups IV, V, and VI of the periodic chart of elements, and combinations thereof.

37. The method according to claim 26, wherein the hard metal is selected from the group consisting of titanium carbide, titanium carbonitride, tungsten carbide, and combinations thereof.

38. A hard metal mixture produced according to the method of claim 26.

39. A sintered hard metal molding produced from the hard metal mixture of claim 38.

* * * * *